US008302896B2

(12) United States Patent
Iwasaki

(10) Patent No.: US 8,302,896 B2
(45) Date of Patent: Nov. 6, 2012

(54) ROLL-PAPER FEEDING DEVICE AND IMAGE FORMING APPARATUS

(75) Inventor: Takeshi Iwasaki, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 275 days.

(21) Appl. No.: 12/717,618

(22) Filed: Mar. 4, 2010

(65) Prior Publication Data

US 2010/0224717 A1 Sep. 9, 2010

(30) Foreign Application Priority Data

Mar. 6, 2009 (JP) ..... 2009-052845

(51) Int. Cl.
*B65H 23/06* (2006.01)

(52) U.S. Cl. ..... 242/421; 242/421.2; 242/421.3; 242/595.1

(58) Field of Classification Search ..... 242/421, 242/421.1–421.4, 422.4, 595.1
See application file for complete search history.

(56) References Cited

U.S. PATENT DOCUMENTS

| | | | | |
|---|---|---|---|---|
| 5,367,746 | A * | 11/1994 | Clement et al. | 19/115 R |
| 6,361,229 | B1 * | 3/2002 | Shinga | 400/613 |
| 6,561,453 | B1 * | 5/2003 | Shinga | 242/595.1 |
| 8,011,611 | B2 * | 9/2011 | Yoshimaru et al. | 242/421 |
| 2009/0266926 | A1 * | 10/2009 | Yoshimaru et al. | 242/421 |

FOREIGN PATENT DOCUMENTS

| | | |
|---|---|---|
| JP | 2003-276264 | 9/2003 |
| JP | 2006-248683 | 9/2006 |

* cited by examiner

*Primary Examiner* — Sang Kim
(74) *Attorney, Agent, or Firm* — Cooper & Dunham LLP

(57) ABSTRACT

In a printer that uses a roll paper being a printing medium, when a 2-inch roll paper is used, as a flange member coaxially fixed to each central portion of both ends of a paper tube of the roll paper in its axial direction, a flange member with a smaller outer diameter than that of the flange member used for a 3-inch roll paper is used.

12 Claims, 4 Drawing Sheets

ROLL-PAPER FEEDING DEVICE AND IMAGE FORMING APPARATUS

CROSS-REFERENCE TO RELATED APPLICATIONS

The present application claims priority to and incorporates by reference the entire contents of Japanese Patent Application No. 2009-052845 filed in Japan on Mar. 6, 2009.

BACKGROUND OF THE INVENTION

1. Field of the Invention

The present invention relates to a roll-paper feeding device for feeding a roll-type sheet medium such as a roll paper and an image forming apparatus provided in which the roll-paper feeding device is incorporated.

2. Description of the Related Art

Conventionally, as a method of holding a roll paper, which is a long-size paper wound around a paper tube as a core, in a paper feeding device, a spool system or a flange system is adopted to deal with various sizes of roll papers.

The spool system has a disadvantage in that a long spool has to be passed through the paper tube of the roll paper, which deteriorates user operability. On the other hand, by providing a drive transmission mechanism in the spool when a rewinding mechanism or the like is provided, the roll paper itself can be easily driven. Moreover, uplift of the roll paper during conveyance thereof can be easily pressed by engagement between a spool shaft and the drive transmission mechanism.

The flange system has very high user operability because the roll paper is held by flange members being inserted into the paper tube from both sides thereof. However, to directly transmit the drive force to the roll paper, only two approaches are available. In one approach, the diameter of the flange member is made larger than a maximum outer diameter of the roll paper to transmit the drive force to the outer diameter of the flange member. In the other approach, a baseline of a paper in its width direction upon its conveyance is set as the edge portion of the paper, so that the drive force is transmitted to the flange member.

If the outer diameter of the flange member is made larger, the diameter of the flange member is also needs to be made larger, which results in an increase of the overall size of the device. Therefore, this approach is disadvantages in that the roll paper has to be set in the device while one side of the roll paper is being held up. Moreover, if the baseline in the width direction upon the conveyance is set as the edge portion of the paper and when the long-size paper is conveyed, a problem may arise in the quality during the conveyance such as shrink, twist, or skew.

Japanese Patent Application Laid-open No. 2006-248683 describes that by holding a roll paper by a spool and using a one-way gear, the drive is transmitted to the spool only upon rewinding, so that high-accuracy conveyance is achieved.

Japanese Patent Application Laid-open No. 2003-276264 adopts a method in which the system is a flange type and the diameter of a flange member is made smaller than a maximum outer diameter of a roll paper and the roll paper is rewound by a receiving roller of the flange member. In this method, if a rewinding speed is constant, the remaining amount of the roll paper is reduced to cause a slip amount of the receiving roller to increase. Moreover, because the rewinding cannot be continuously performed, the roll paper cannot be rewound for a long distance.

To take care of the disadvantages of a sheet conveying device described in Japanese Patent Application Laid-open No. 2003-276264 and of continuously rewinding the roll paper, the applicants of the present application have proposed that the flange member is reversely rotated by a rewinding roller through the receiving roller of the flange member to allow continuous rewinding of the paper, and that drive transmission between the rewinding roller and the receiving roller and between the receiving roller and the flange member is carried out based on friction or on magnetic force and slip. By doing so, paper tension force when the roll paper is to be rewound through a conventional gear or the like allows stable rewinding without changing a rewinding speed according to a change in a roll diameter.

However, when the drive transmission is carried out by friction, because the flange member of the roll paper is just put on the receiving roller, when the roll paper is intermittently conveyed in a forward feeding direction, the roll paper is uplifted from the receiving roller being a rotation support member with a quicker rising time at which the roll paper is started to rotate, which causes unstable rotation, and brake force becomes insufficient to cause slack of the paper, which may cause the skew. Particularly, the diameter size of the paper tube of the roll paper includes 2 inches and 3 inches as general specifications. Thus, a difference occurs between their weights and between their centers of gravity, and conditions for the roll papers that do not uplift are thereby largely different from each other.

Furthermore, when the drive transmission is carried out by magnetic force, uplift of the roll paper can be prevented. However, because it is necessary to newly provide an electromagnet device, this case has disadvantages in that the device is complicated to result in a cost increase.

SUMMARY OF THE INVENTION

It is an object of the present invention to at least partially solve the problems in the conventional technology.

According to an aspect of the present invention, there is provided a roll-paper feeding device including a roll paper configured by winding a paper around a paper tube; a circular plate shaped flange member fixed to each of both ends of the roll paper to hold the roll paper; at least two rotation support members that rotatably support the flange member; a rewinding roller that is engaged with at least one of the rotation support members and rotates the flange member in an opposite direction to a forward feeding direction of the roll paper; a paper feed roller that applies conveying force to the paper and applies rotation in the forward feeding direction to the roll paper via the paper; and a drive unit that transmits drive force required for conveyance of the paper to the paper feed roller. A plurality of the flange members each with a different outer diameter for each outer diameter of the paper tube of the roll paper is provided.

According to another aspect of the present invention, there is provided a roll-paper feeding device including a roll paper configured by winding a paper around a paper tube; a circular plate shaped flange member fixed to each of both ends of the roll paper to hold the roll paper; at least two rotation support members that rotatably support the flange member; a rewinding roller that is engaged with at least one of the rotation support members and rotates the flange member in an opposite direction to a forward feeding direction of the roll paper; a paper feed roller that applies conveying force to the paper and applies rotation in the forward feeding direction to the roll paper via the paper; and drive means for transmitting drive force required for conveyance of the paper to the paper feed roller. A plurality of the flange members each with a different outer diameter for each outer diameter of the paper tube of the roll paper is provided.

According to still another aspect of the present invention, there is provided an image forming apparatus that includes the above roll-paper feeding device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to FIGS. 1 to 4.

Figure 1:
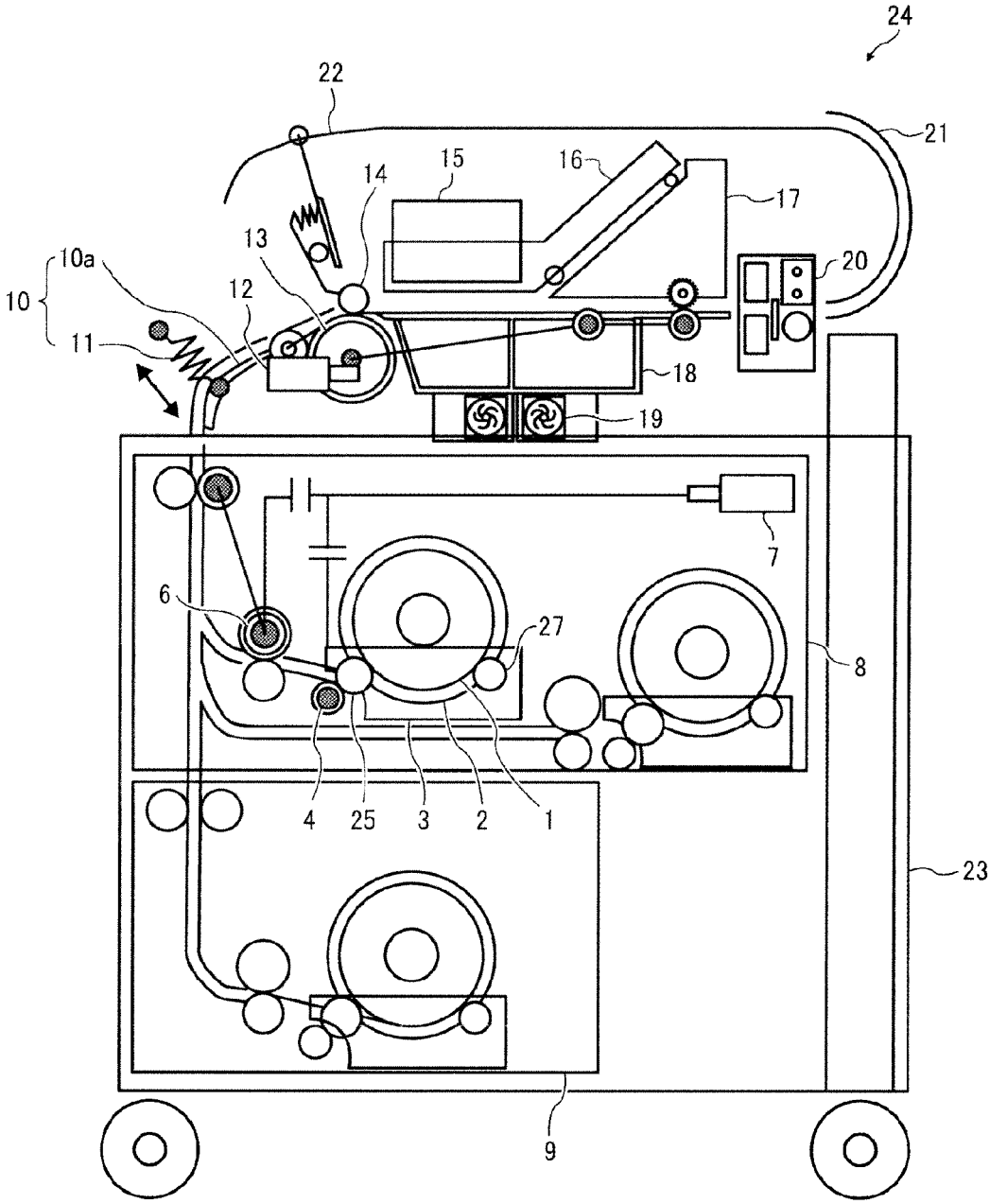
FIG. 1 is a schematic configuration diagram representing an image forming apparatus according to an exemplary embodiment.
Figure 2:
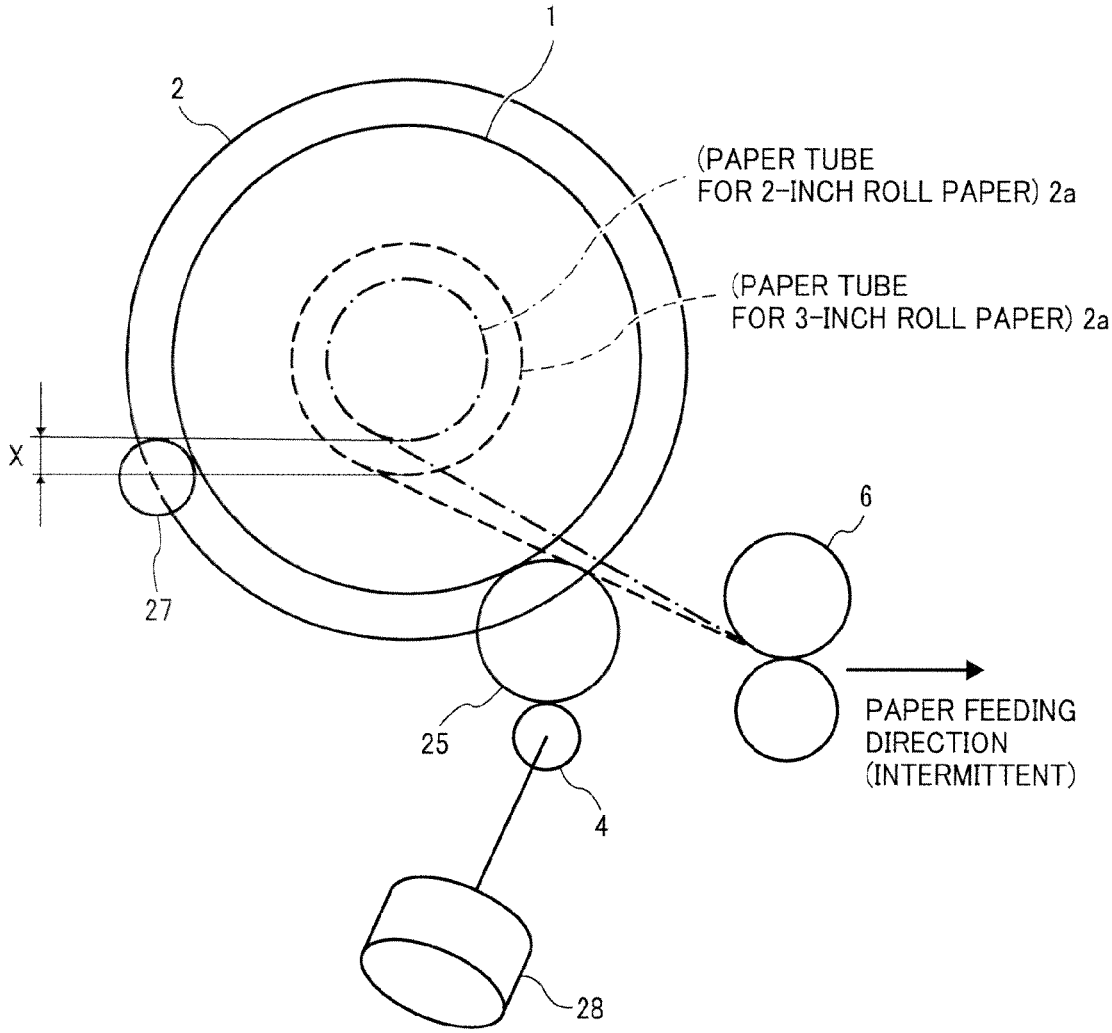
FIG. 2 is a schematic configuration diagram of a portion of a conventional roll-paper conveying device in the image forming apparatus shown in FIG. 1.
Figure 3:
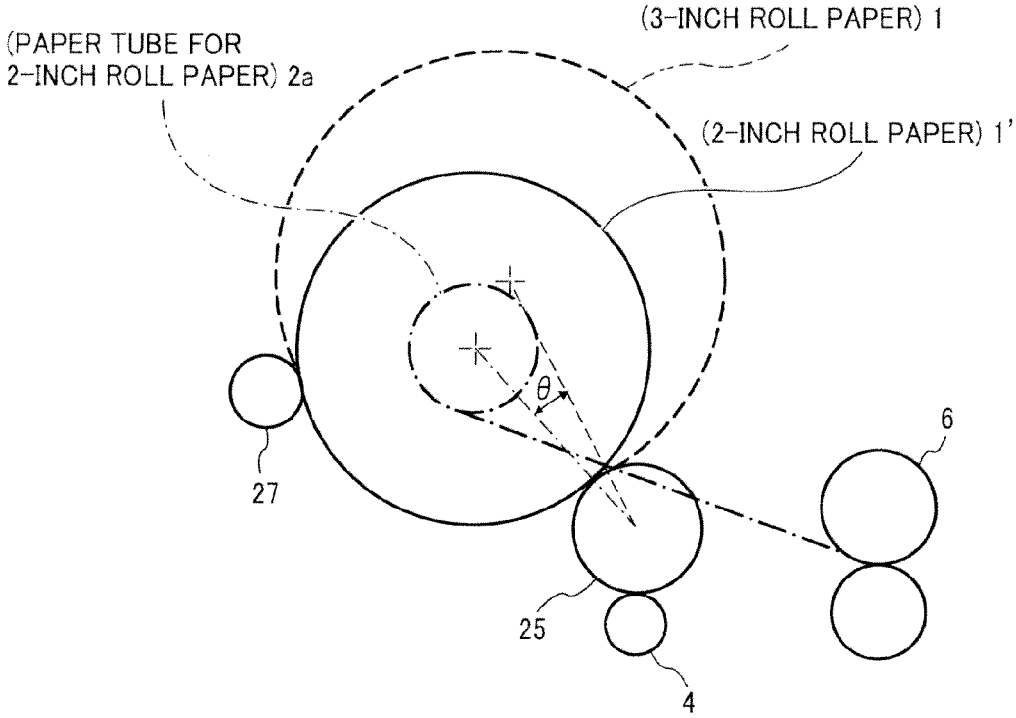
FIG. 3 is a schematic configuration diagram of a portion of a roll-paper conveying device to which the present invention is applied in the image forming apparatus shown in FIG. 1.
Figure 4:
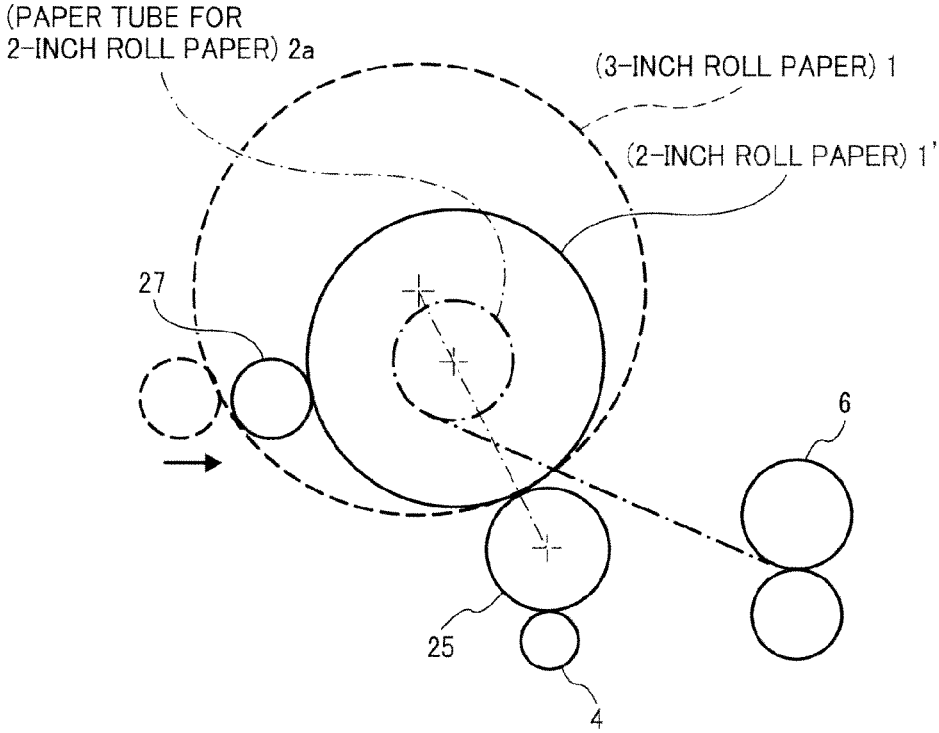
FIG. 4 is a schematic configuration diagram of the portion of the roll-paper conveying device to which the present invention is applied in the image forming apparatus shown in FIG. 1.

FIG. 1 is a schematic configuration diagram representing an image forming apparatus according to one embodiment of the present invention. FIG. 2 is a schematic configuration diagram of a portion of a conventional roll-paper conveying device in the image forming apparatus shown in FIG. 1. FIG. 3 is a schematic configuration diagram of a portion of a roll-paper conveying device to which the present invention is applied in the image forming apparatus shown in FIG. 1. FIG. 4 is a schematic configuration diagram of the portion of the roll-paper conveying device to which the present invention is applied in the image forming apparatus shown in FIG. 1.

An ink-jet printer 24 is explained below as an example of an image forming apparatus according to one embodiment of the present invention. As shown in FIG. 1, the ink-jet printer 24 includes a main body 23. Inside the main body 23 are arranged an upper roll tray 8, a lower roll tray 9, a paper tension applying unit 10, a drive motor 12, a registration roller 13, a registration pressure roller 14, a head 15, a carriage 16, a main-scanning stay 17, a chamber 18, an air intake fan 19, a cutter 20, a reverse-paper ejection guide 21, and a paper ejection tray 22.

The upper roll tray 8 includes a flange member 1, a roll paper 2, a flange cradle 3, a rewinding roller 4, a paper feed roller 6, a drive unit 7, and a one-way clutch 28 (see FIG. 2).

The flange member 1 is a circular plate. Moreover, an outer diameter of the flange member 1 is smaller than the maximum outer diameter of the roll paper 2. The roll paper 2 is arranged on a paper tube 2*a*. Moreover, one flange member 1 is arranged coaxially with and on either sides of the roll paper 2 on a paper tube 2*a* in its axial direction.

The roll paper 2 is obtained by winding a long paper around the periphery of the paper tube (core) 2*a*. The roll paper 2 can have various sizes i.e., various outer diameters. In the present embodiment, it is assumed that a roll paper having a 2-inch outer diameter (2-inch roll paper) or a roll paper having a 3-inch outer diameter (3-inch roll paper), which are commonly used sixes, can be used as the roll paper 2 in the printer 24.

The flange cradle 3 rotatably supports a relay roller 25 and a support roller 27 that function as rotation support members. The flange member 1 is placed on these rotation support members so that an outer peripheral surface of the flange member 1 is in contact with these rotation support members. That is, the flange member 1 is rotatably supported by these rotation support members.

The relay roller 25 supports the outer peripheral surface of the flange member 1 at one end (the side of paper feed roller 6) of the flange cradle 3. Moreover, the relay roller 25 is in contact with (engaged with) the rewinding roller 4. On the other hand, the support roller 27 supports the outer periphery of the flange member 1 at the other end of the flange cradle 3. As explained in detail later, the support roller 27 is arranged in such a manner that it can be shifted or moved depending on the outer diameter of the flange member 1.

The rewinding roller 4 is a long roller having a length that allows the rewinding roller 4 to be in contact with the relay rollers 25 of the two flange cradles 3 located at both ends of the roll paper 2. When the paper feed roller 6 is reversely rotated in order to reversely drive the leading edge of the paper on the roll paper 2 side for a predetermined distance, the rewinding roller 4 is driven by the drive unit 7 in such a manner that the drive force is transmitted by frictional contact from the rewinding roller 4 to the relay roller 25 and then from the relay roller 25 to the flange member 1 so that the flange member 1 is reversely rotated.

The one-way clutch 2B that functions as a clutch mechanism is coupled to the rewinding roller 4 as shown in FIG. 2. The one-way clutch 28 transmits the drive force from the drive unit 7, which is explained later, at the time of rewinding rotation, and does not transmit the drive force at the time of forward rotation. In other words, the rewinding roller 4 includes the one-way clutch 28.

The paper feed roller 6 is configured from a pair of rollers. When the paper feed roller 6 rotates in response to a driving force from the drive unit 7, the paper of the roll paper 2 passes through the pair of rollers and it is conveyed in the forward feeding direction so that the paper of the roll paper 2 is conveyed to the paper tension applying unit 10.

The drive unit 7 is configured with, for example, a motor. The drive unit 7 applies a drive force to the paper feed roller 6 and the rewinding roller 4 when conveying the paper in the forward direction or when rewinding the paper.

Provided within the upper roll tray 8 is another unit of a roll-paper feeding device configured from the flange member 1, the roll paper 2, the flange cradle 3, the rewinding roller 4, and the paper feed roller 6. Furthermore, the lower roll tray 9 is provided in the lower side of the upper roll tray 8, and still another unit of a roll-paper feeding device configured as above is provided therein.

The paper conveyed from the paper feed roller 6 is conveyed to the paper tension applying unit 10 arranged in the paper conveying path. The paper tension applying unit 10 is basically configured from a conveying guide 10*a* which is swingable on the internal peripheral side and a spring 11. The paper tension applying unit also serves as a buffer function with respect to the tension of the paper that is being fed.

The paper from the paper tension applying unit 10 is conveyed in a nip between the registration roller 13 and the registration pressure roller 14 that are arranged further downstream side of the paper tension applying unit 10. Subsequently, the paper is conveyed onto a platen plate that is arranged above the chamber 18 that functions as a printing unit. A negative pressure is maintained in the chamber 18 by the air intake fan 19 disposed below the chamber 18, and holes are formed in the platen plate. With this configuration, the paper is attracted to the platen plate and the flatness of the paper is maintained.

The carriage 16 with the head 15 mounted thereon to eject ink is disposed above the platen plate. The carriage 16 reciprocates in the width direction of the paper along the main-scanning stay 17 and ejects ink toward the paper held on the platen plate when forming an image on the paper. The paper is fed by a predetermined length by the registration roller 13 each time when the carriage 16 moves corresponding to the width of the head 15 (intermittent conveyance), is cut by a predetermined length by the cutter 20 after the image is formed, is conveyed along the reverse-paper ejection guide 21, and is ejected to the paper ejection tray 22.

In the roll-paper feeding device provided in the printer 24 configured as above, when the paper is fed by intermittent operation, the feeding force of the paper causes the flange member 1 to jump if the paper remaining in the roll paper 2 is less. Due to such jumping, the rotation of the flange member 1 becomes unstable, the brake force becomes insufficient leading to occurrence of slack and skew.

Further, as explained above, the roll paper 2 can be a 2-inch roll paper or a 3-inch roll paper. Assuming that the positions of the relay roller 25 and the support roller 27 are not changed, as shown in FIG. 2, the position of the 2-inch roll paper 2 with respect to the paper feed roller 6 is higher (by an amount x in FIG. 2), in addition, the 2-inch roll paper 2 is lighter in weight than the 3-inch roll paper. Because of these facts, the 2-inch roll paper 2 is easily uplifted when it is pulled by the paper feed roller 6.

Therefore, in the embodiment, for the 2-inch roll paper 2, a smaller-diameter flange member 1' is used. As a result, a positional relation (position of the paper tube 2*a* in the lower side of FIG. 3) of the outer shape (outer diameter) of the flange member 1 with respect to the paper feed roller 6 maintained the same as that of the case of the 3-inch roll paper 2. Because of the use of the smaller-diameter flange member 1', as shown in FIG. 3, the position of center of gravity of the roll paper 2 lowers, which prevents uplift of the roll paper 2 when the paper is pulled by the paper feed roller 6 upon feeding of the paper by intermittent operation. That is, in the embodiment, plural flange members 1 each having a different outer diameter are prepared. The outer diameters of the flange members 1 correspond to the outer diameter of the paper tubes of the roll papers 2. This configuration is not limited to the 2-inch roll paper 2 or the 3-inch roll paper 2 but can be applied to roll papers of any other size. More specifically, the flange member 1 having a smaller outer diameter is selected for a paper tube a smaller outer diameter.

In this configuration, however, as shown in FIG. 3, a contact angle between the relay roller 25 and the flange member 1 (θ in FIG. 3) changes. In the embodiment, when the rewinding roller 4 is driven, because a configuration has been adopted in which the drive force is transmitted by the frictional contact from the rewinding roller 4 to the relay roller 25 and then from the relay roller 25 to the flange member 1, if the contact angle between the relay roller 25 and the flange member 1 changes, the direction of applying the weight of the flange member 1 and the roll paper 2 to the relay roller 25 also changes. The change in the direction of applying the weight of the flange member 1 and the roll paper 2 to the relay roller 25 causes rewinding conditions to become different between the 2-inch roll paper 2 and the 3-inch roll paper 2.

As shown in FIG. 4, therefore, the support roller 27 is arranged in such a manner that it can be shifted or moved in the longitudinal direction of the flange cradle 3 (direction toward the paper feed roller 6 and its reverse direction). The shifting of the support roller 27 is performed by operating a lever that functions as a position changing unit (not shown). When the smaller-diameter flange member 1 is used for the 2-inch roll paper 2, the position of the support roller 27 is moved so as to be closer to the relay roller 25. As a result, it is possible to maintain the contact angle between the relay roller 25 and the flange member 1 the same as that for the 3-inch roll paper 2. The rewinding conditions of the roll paper 2 can thereby be maintained to the same conditions even if the roll paper size is different from other ones, and thus the rewinding of the roll paper 2 can be stably performed. More specifically, there is provided the position changing unit that changes the position of the support roller 27, of rotation support members, not engaged with the rewinding roller 4 according to the outer diameter of the paper tube of the roll paper 2.

According to the embodiment, as the flange member 1 coaxially fixed to each central portion of the both ends of the paper tube 2*a* of the roll paper 2 in the axial direction, in the case of the 2-inch roll paper 2, the flange member 1' with a smaller diameter than that of the flange member 1 used for the 3-inch roll paper 2 is used. Therefore, the position of center of gravity of the roll paper 2 can be set as an appropriate condition so that the roll paper 2 is prevented from being uplifted from the relay roller 25 and the support roller 27, thus preventing uplift of the roll paper 2 and performing stable intermittent conveyance even if the diameter size of the paper tube of the roll paper 2 is different from that of others.

Moreover, even if the outer shape of the flange member 1 is changed according to the diameter size of the paper tube of the roll paper 2, the support roller 27 can be moved so as to keep constant the contact angle between the flange member 1 and the rewinding roller 4. Therefore, the rewinding condition of the roll paper 2 can be kept to the same condition even if the roll paper 2 has a different size from others, and stable rewinding of the roll paper 2 can thereby be performed with a simple configuration.

Furthermore, because the one-way clutch 28 is connected to the rewinding roller 4, the rewinding roller 4 can be stopped from rotating at the time of feeding forward the roll paper 2, and the roll paper 2 can be fed forward always in a state of braking the flange member 1 due to friction. Therefore, when the roll paper 2 is fed forward by the intermittent operation, the flange member 1 can be stopped from rotating more quickly than the paper feed roller 6 so that the paper is prevented from being slack between the paper feed roller 6 and the flange member 1.

Figure 1A:
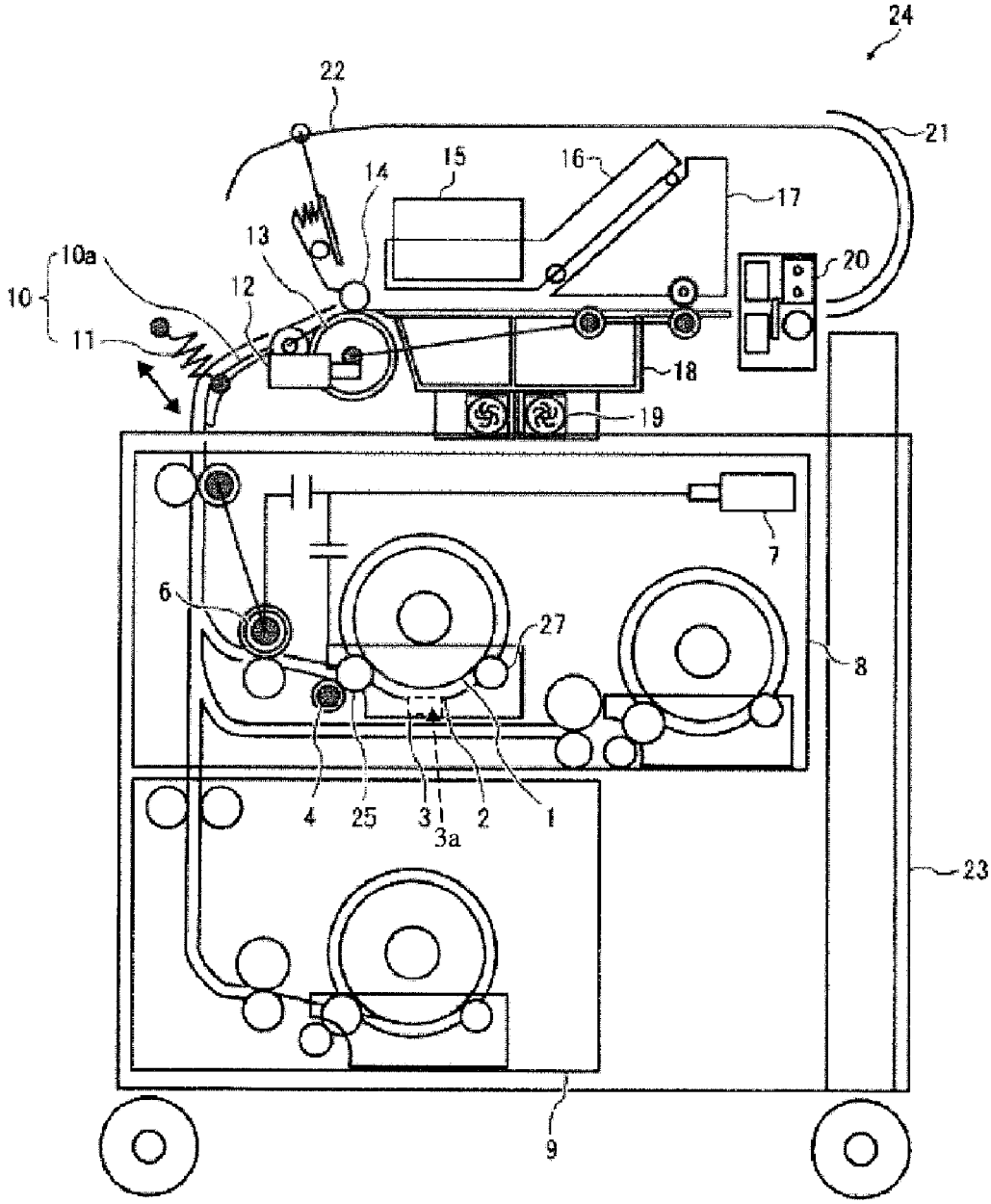
FIG. 1A is a schematic configuration diagram representing an image forming apparatus according to another exemplary embodiment.

In the embodiment of FIG. 1 the flange member 1 of which outer shape is changed for each diameter size of the paper tube of the roll paper 2 is used, however, the configuration is not limited thereto. For example (FIG. 1A) a sensor 3*a* that functions as a remaining-amount detector and detects a weight of the roll paper 2 may be provided in the flange cradle 3 or the like, the remaining amount of the roll paper 2 may be estimated from the weight detected by the sensor 3*a*, and the flange member 1 is changed to a flange with a different outer shape according to the remaining amount. More specifically, there is provided a plurality of flange members 1 each with a different outer shape according to each remaining amount of the roll paper 2 detected by the remaining-amount detector 3*a*.

In this case, even if the outer diameter of the paper tube of the roll paper 2 is, for example, 3 inches, when the remaining amount of the roll paper 2 decreases below a threshold of a predetermined remaining amount, an operation panel (not shown) or the like is used to display "change to the flange member 1 for 2-inch roll paper" thereon so as to prompt the user to change it. Moreover, a plurality of types of specific flange members 1, not shared by the flange member 1 according to the outer diameter of the paper tube, but may be prepared and used according to each remaining amount.

Furthermore, even if the flange member 1 is changed according to the remaining amount of the roll paper 2, the support roller 27 may be moved so as to keep constant the contact angle between the flange member 1 and the rewinding roller 4.

According to the present invention, the position of center of gravity of the roll paper can be set as the appropriate condition so that the roll paper does not uplift from the rotation support member, to prevent the uplift of the roll paper, which allows stable intermittent conveyance of the roll paper with a simple configuration even if the diameter sizes of the paper tubes of the roll papers are different from each other.

According to the present invention, the contact angle between the rewinding roller and the flange member is kept constant, so that the rewinding condition of the roll paper can be kept to the same condition even if the sizes of the roll papers are different from each other, and stable rewinding of the roll paper can thereby be performed with a simple configuration.

According to the present invention, even if the remaining amount of the roll paper decreases, the position of center of gravity of the roll paper can be set as the appropriate condition so that the roll paper does not uplift from the rotation support member, to prevent uplift of the roll paper, which allows the stable intermittent conveyance with the simple configuration even if the remaining amount of the roll paper decreases.

According to the present invention, the contact angle between the rewinding roller and the flange member is kept constant, so that the rewinding condition of the roll paper can be kept to the same condition even if the remaining amount of the roll paper decreases, and stable rewinding of the roll paper can thereby be performed with the simple configuration.

According to the present invention, the rewinding roller can be stopped from rotating at the time of feeding forward the roll paper, and the roll paper can be fed forward in a state in which the flange member is always applied brakes due to friction. Thus, when the roll paper is fed forward by the intermittent operation, the flange member can be stopped more quickly than the paper feed roller so that the paper is prevented from being slack between the paper feed roller and the flange member.

According to the present invention, the image forming apparatus allows prevention of uplift of the roll paper and stable intermittent conveyance even if the diameter sizes of the paper tubes of the roll papers are different from each other.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A roll-paper feeding device that feeds a roll paper configured by winding a paper around a paper tube, the roll-paper feeding device comprising:

at least two rotation support members configured to rotatably support a circular plate shaped flange member fixed to each of both ends of the roll paper to hold the roll paper;

a rewinding roller configured to be engaged with at least one of the two rotation support members and rotate the flange member in an opposite direction to a forward feeding direction of the roll paper;

a paper feed roller configured to apply conveying force to the paper and apply rotation in the forward feeding direction to the roll paper via the paper;

a drive unit configured to transmit drive force required for conveyance of the paper to the paper feed roller; and a position changing unit configured to change a position interval between a position of the one of the two rotation support members that is engaged with the rewinding roller and a position of another one of the two rotation support members that is not engaged with the rewinding roller, in accordance with an outer diameter of the flange member, the position interval being along a direction perpendicular to an axial direction of the paper tube or to a width direction of the roll paper.

2. The roll-paper feeding device according to claim 1, wherein the position changing unit a changes the position of the rotation support member that is not engaged with the rewinding roller to keep constant a contact angle between the flange member and the rotation support member that is engaged with the rewinding roller, in accordance with the outer diameter of the flange member.

3. The roll-paper feeding device according to claim 2, further comprising:

a remaining-amount detector configured to detect a remaining amount of the roll paper around the paper tube, wherein the flange member is selected from plural flange members, each of which has a different outer diameter, in accordance with the remaining amount of the roll paper detected by the remaining-amount detector.

4. The roll-paper feeding device according to claim 3, wherein the position changing unit is configured to change a position of the rotation support member that is not engaged with the rewinding roller, in accordance with an outer diameter of the selected flange member.

5. The roll-paper feeding device according to claim 1, wherein the rewinding roller is provided with a clutch mechanism that transmits the drive force upon rewinding rotation and does not transmit the drive force upon forward rotation.

6. An image forming apparatus comprising the roll-paper feeding device according to claim 1.

7. A roll-paper feeding device that feeds a roll paper configured by winding a paper around a paper tube, the roll-paper feeding device comprising:

at least two rotation support members configured to rotatably support a circular plate shaped flange member fixed to each of both ends of the roll paper to hold the roll paper;

a rewinding roller configured to be engaged with at least one of the two rotation support members and rotate the flange member in an opposite direction to a forward feeding direction of the roll paper;

a paper feed roller configured to apply conveying force to the paper and apply rotation in the forward feeding direction to the roll paper via the paper;

drive means for transmitting drive force required for conveyance of the paper to the paper feed roller; and position changing means for changing a position interval between a position of the one of the two rotation support members that is engaged with the rewinding roller and a position of another one of the two rotation support members that is not engaged with the rewinding roller, in accordance with, an outer diameter of the flange member, the position interval being along a direction perpendicular to an axial direction of the paper tube or to a width direction of the roll paper.

8. The roll-paper feeding device according to claim 7, wherein the position changing means changes the position of the rotation support member that is not engaged with the rewinding roller to keep constant a contact angle between the flange member and the rotation support member that is engaged with the rewinding roller, in accordance with the outer diameter of the flange member.

9. The roll-paper feeding device according to claim 8, further comprising:

remaining-amount detecting means for detecting a remaining amount of the roll paper around the paper tube, wherein the flange member is selected from plural flange members, each of which has a different outer diameter, in accordance with the remaining amount of the roll paper detected by the remaining-amount detecting means.

10. The roll-paper feeding device according to claim 9, wherein the position changing means changes a position of the rotation support member that is not engaged with the rewinding roller, in accordance with the outer diameter of the flange member.

11. The roll-paper feeding device according to claim 7, wherein the rewinding roller is provided with a clutch means for transmitting the drive force upon rewinding rotation and not transmitting the drive force upon forward rotation.

12. An image forming apparatus comprising the roll-paper feeding device according to claim 7.

* * * * *